US011635236B2

(12) United States Patent
Lowe et al.

(10) Patent No.: US 11,635,236 B2
(45) Date of Patent: Apr. 25, 2023

(54) OPTIMIZATION SENSOR AND POOL HEATER UTILIZING SAME AND RELATED METHODS

(71) Applicant: Heating Solutions LLC, Chicago, IL (US)

(72) Inventors: Zachary Lowe, Harrison, OH (US); Charles Murphy, Oakwood, OH (US)

(73) Assignee: Intermatic Incorporated, Libertyville, IL (US)

( * ) Notice: Subject to any disclaimer, the term of this patent is extended or adjusted under 35 U.S.C. 154(b) by 6 days.

(21) Appl. No.: 16/159,190

(22) Filed: Oct. 12, 2018

(65) Prior Publication Data

US 2019/0113260 A1 Apr. 18, 2019

Related U.S. Application Data

(60) Provisional application No. 62/572,072, filed on Oct. 13, 2017.

(51) Int. Cl.

| | |
|---|---|
| ***F25B 30/02*** | (2006.01) |
| ***F25B 49/00*** | (2006.01) |
| ***E04H 4/12*** | (2006.01) |
| ***F24H 4/02*** | (2022.01) |
| ***F25B 49/02*** | (2006.01) |

(52) U.S. Cl.

CPC ..... *F25B 30/02* (2013.01); *E04H 4/129* (2013.01); *F24H 4/02* (2013.01); *F25B 49/005* (2013.01); *F25B 49/022* (2013.01); *F25B 2339/047* (2013.01); *F25B 2700/15* (2013.01); *F25B 2700/1931* (2013.01); *F25B 2700/1933* (2013.01)

(58) Field of Classification Search

CPC ..... F25B 30/02; F25B 49/005; F25B 49/22; F25B 2339/047; F25B 2700/15; F25B 2700/1933; E04H 4/129; F24H 4/02

See application file for complete search history.

(56) References Cited

U.S. PATENT DOCUMENTS

| | | | | |
|---|---|---|---|---|
| 3,707,851 | A | 1/1973 | Mcashan | |
| 4,217,761 | A | 8/1980 | Cornaire | |
| 4,262,736 | A | 4/1981 | Gilkeson | |
| 4,325,223 | A | 4/1982 | Cantley | |
| 4,439,997 | A | 4/1984 | Cantley | |
| 4,574,871 | A | 3/1986 | Parkinson | |
| 4,882,928 | A | 11/1989 | Lane, Jr. | |
| 6,109,050 | A * | 8/2000 | Zakryk | E04H 4/129 4/493 |
| 7,010,925 | B2 * | 3/2006 | Sienel | F25B 9/008 62/115 |

(Continued)

FOREIGN PATENT DOCUMENTS

| | | | |
|---|---|---|---|
| JP | 2012247122 | A * | 12/2012 |
| WO | 1990004172 | | 4/1990 |

(Continued)

*Primary Examiner* — Kun Kai Ma

(74) *Attorney, Agent, or Firm* — Fitch, Even, Tabin & Flannery, LLP

(57) ABSTRACT

An operational efficiency apparatus comprising a sensor connected to a heat transfer system to detect efficiency of system and a display electrically connected to the sensor for indicating efficiency of the system based on data detected from the sensor.

15 Claims, 4 Drawing Sheets

(56) References Cited

U.S. PATENT DOCUMENTS

| | | | |
|---|---|---|---|
| 7,114,343 | B2 | 10/2006 | Kates |
| 7,244,294 | B2 | 7/2007 | Kates |
| 7,275,377 | B2 | 10/2007 | Kates |
| 7,331,187 | B2 | 2/2008 | Kates |
| 7,343,751 | B2 | 3/2008 | Kates |
| 7,469,546 | B2 | 12/2008 | Kates |
| 7,721,360 | B2 | 5/2010 | Bernardi |
| 7,752,854 | B2 | 7/2010 | Singh |
| 8,034,170 | B2 | 10/2011 | Kates |
| 8,332,075 | B2 | 12/2012 | Harrod |
| 8,528,831 | B2 | 9/2013 | Lin |
| 8,850,348 | B2 | 9/2014 | Fadell |
| 8,918,219 | B2 | 12/2014 | Sloo |
| 9,021,819 | B2 | 5/2015 | Kates |
| 9,081,394 | B2 | 7/2015 | Kates |
| 9,304,521 | B2 | 4/2016 | Kates |
| 9,310,094 | B2 | 4/2016 | Kates |
| 9,453,655 | B2 | 9/2016 | Bruck |
| 9,476,606 | B2 | 10/2016 | Fadell |
| 9,574,810 | B1 | 2/2017 | West |
| 9,638,436 | B2 | 5/2017 | Arensmeier |
| 9,732,979 | B2 | 8/2017 | Fadell |
| 2006/0150646 | A1* | 7/2006 | Aflekt ..... F25B 9/008 62/157 |
| 2006/0196197 | A1 | 9/2006 | Kates |
| 2007/0244576 | A1* | 10/2007 | Potucek ..... G05D 23/1931 700/55 |
| 2008/0216495 | A1 | 9/2008 | Kates |
| 2008/0223051 | A1 | 9/2008 | Kates |
| 2013/0066472 | A1 | 3/2013 | Harrod |
| 2014/0109322 | A1 | 4/2014 | Park |
| 2014/0167970 | A1* | 6/2014 | Gado ..... F25B 49/005 340/614 |
| 2016/0076950 | A1 | 3/2016 | Jacquet |
| 2016/0113415 | A1* | 4/2016 | Albregts ..... G07F 11/62 62/246 |
| 2016/0361974 | A1 | 12/2016 | Porras |
| 2017/0159982 | A1 | 6/2017 | West |

FOREIGN PATENT DOCUMENTS

| | | |
|---|---|---|
| WO | 2005121659 | 12/2005 |
| WO | 2006023075 | 3/2006 |
| WO | 2007047886 | 4/2007 |
| WO | 2014144446 | 9/2014 |
| WO | 2014174199 | 10/2014 |

* cited by examiner

100

OPTIMIZATION SENSOR AND POOL HEATER UTILIZING SAME AND RELATED METHODS

CROSS REFERENCE TO RELATED APPLICATIONS

This application claims the benefit of U.S. Provisional Application No. 62/572,072, filed Oct. 13, 2017, which is incorporated herein by reference in its entirety.

FIELD

This invention relates generally to optimization sensors and heater pumps, and, more particularly, to optimization of heater pumps for pools and related methods.

BACKGROUND

The efficiency of a pool heat pump can be impacted by a variety of factors, such as the pressure of the coolant. Currently, pool owners have no easy way of knowing whether or not their heat pump is operating efficiently. If the efficiency drops, the heat pump continues to heat the water inefficiently, drastically increasing the wear on the heat pump as well as the electricity consumed and expense of maintaining a pool at the desired temperature. The user remains unaware of this inefficiency until receiving an elevated electrical bill or until a component of the heat pump breaks.

In addition to the increased immediate cost of additional electrical consumption, the inefficient use of a heat pump decreases its expected lifespan leading to additional increased costs in the future.

Accordingly, it has been determined that a need exists for a means of indicating that a pool heat pump is operating efficiently.

BRIEF DESCRIPTION OF THE FIGURES

Embodiments of the invention are illustrated in the figures of the accompanying drawings in which.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE INVENTION

Many variations of optimization sensors and heat pump optimization systems are discussed and contemplated herein and even further are contemplated in view of this disclosure. The systems discussed herein are configured, and designed, to monitor the efficiency of a heat pump and indicate to the user when the heat pump is running inefficiently. In some embodiments, the optimization system comprises a sensor configured to monitor one or more factors that impact efficiency, such as coolant pressure or flow rate, and control an indicator when the measured value falls outside of a predetermined threshold.

Figure 1A:
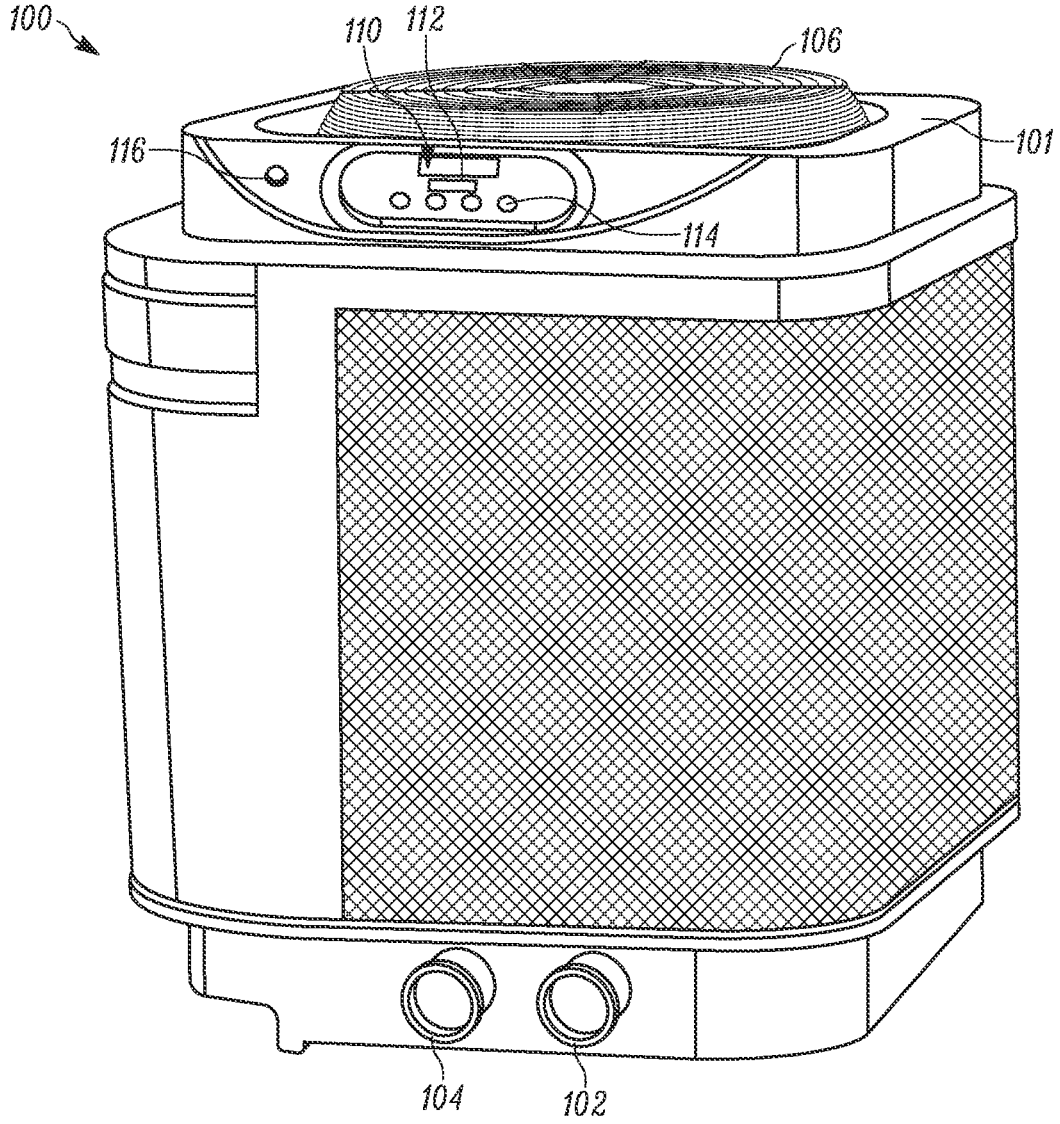
FIG. 1A is a perspective view of a heat pump for use with a recreational swimming pool.
Figure 1B:
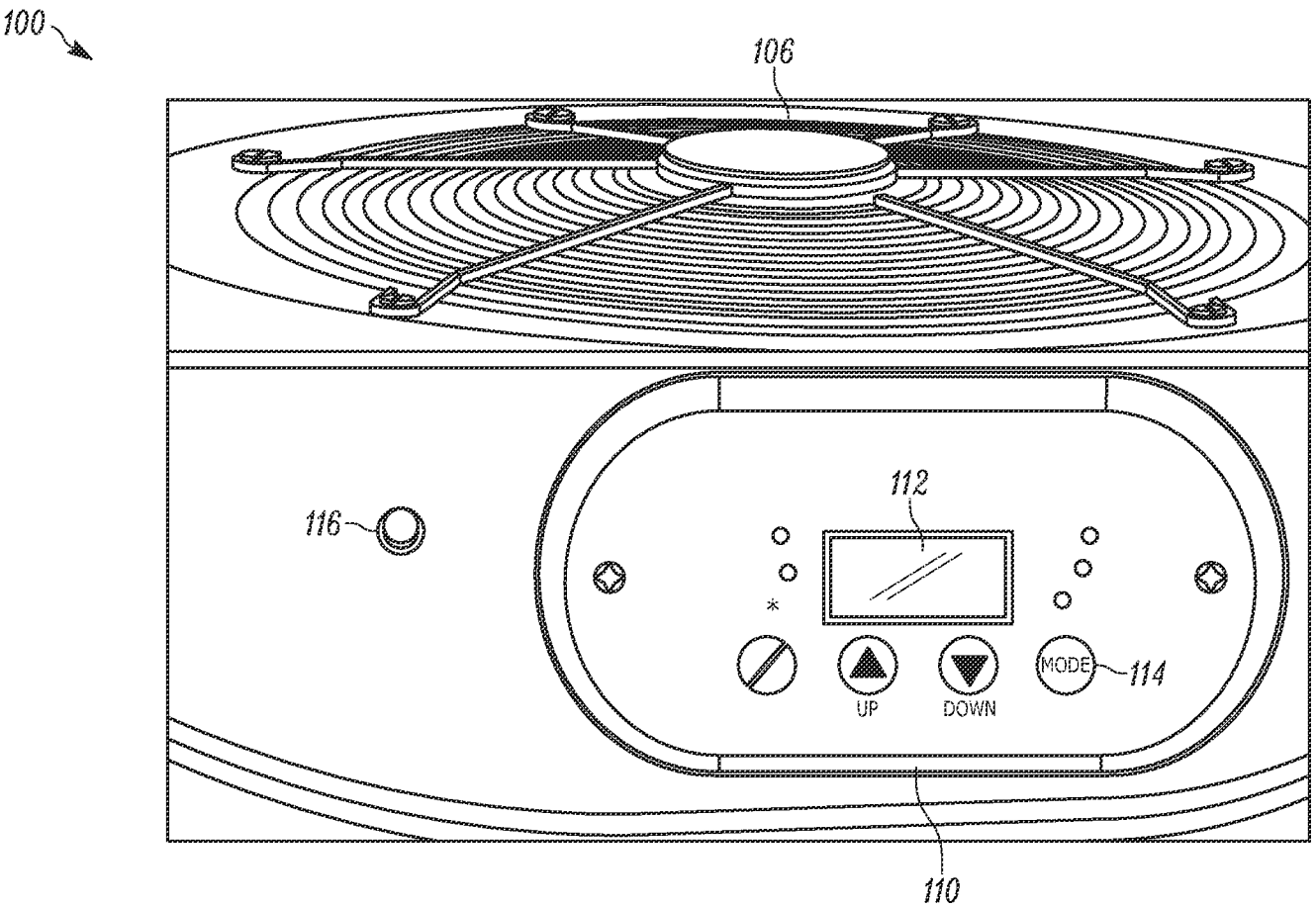
FIG. 1B is an enlarged or expanded view of the heat pump of FIG. 1A showing the user interface and optimization sensor used with same.

FIGS. 1A-1B illustrates an exemplary pool heat pump 100. The heat pump 100 has a water inlet 102, a water outlet 104, and a fan 106. The heat pump intakes water from the pool, transfers heat from the ambient air into the water, and outputs the heated water back into the pool. The heat pump 100 further includes a user interface 110. The interface 110 includes a display 112, user inputs, such as buttons 114, and one or more indicators 116 such as display lights. In one form, the indicators 116 are LED lights. Additionally or alternatively, the indicators can include audio indicators, such as buzzers. As shown in FIG. 1B, the indicator 116 in the present embodiment is a single LED positioned on an exterior wall of the housing 101 of the heat pump 100.

Figure 2:
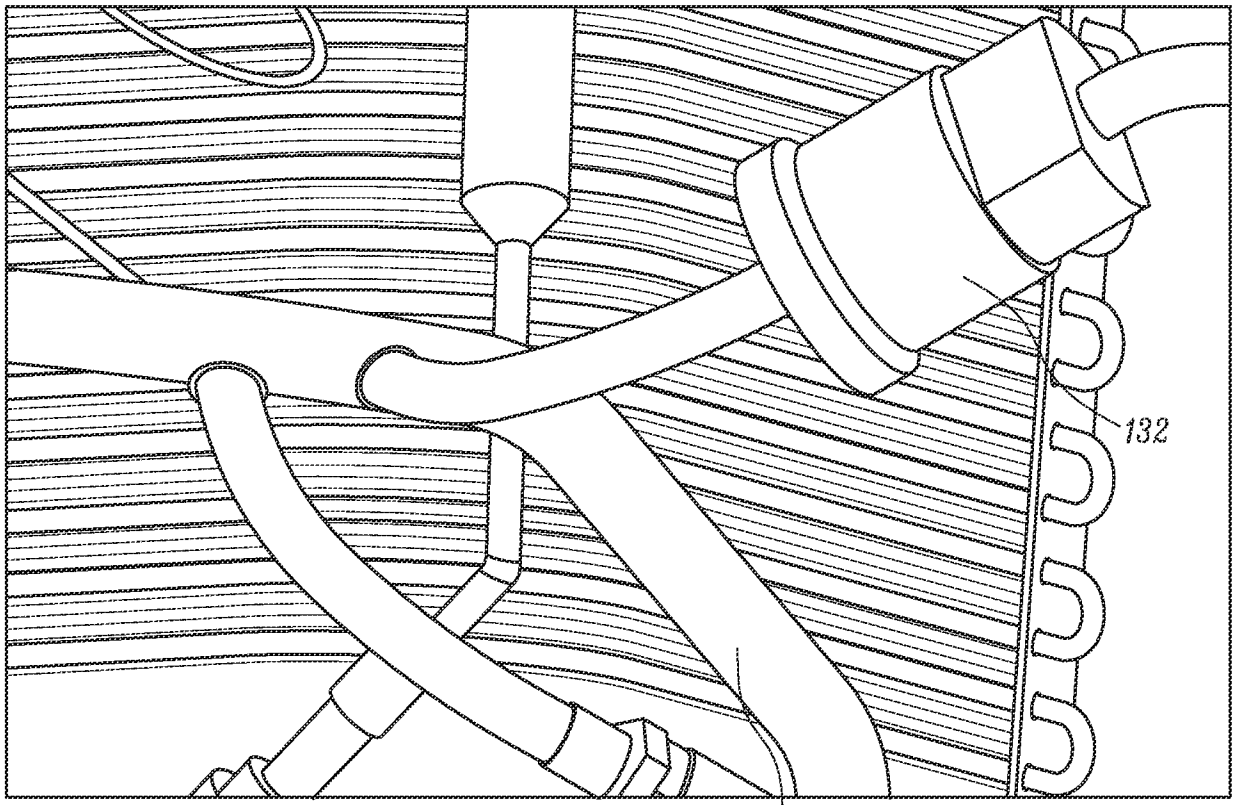
FIG. 2 is a perspective view of an optimization pressure switch coupled to the heat pump of FIG. 1A.

FIG. 2 illustrates a portion of the interior of the heat pump 100. The heat pump 100 has an enclosed system 130 for compressing and expanding a coolant, such as a halocarbon or chlorofluorocarbon (e.g., Freon®). A pressure sensor or pressure switch 132 is coupled to the system 130 to measure the pressure of the coolant. In some forms, the pressure switch 132 is a binary switch that changes states when the measured pressure rises above or drops below a specific point. In alternative embodiments, the pressure switch 132 is a pressure sensor, a controller, and a switch. The pressure sensor measures the pressure of the refrigerant and transmits it to the controller. The controller operates the switch in response to the measured pressure values.

The system 130 includes a high pressure portion and a low pressure portion separate by an expansion valve. The low pressure portion comprises pipes exposed to ambient air that is directed over the pipes by the fan 106. Through this, the expanded refrigerant is warmed by the ambient air. After being warmed, the refrigerant is compressed by a compressor, which heats the refrigerant further. The compressed refrigerant flow through a heat exchanger or condenser submerged in or exposed to pool water. The condenser is located between the water inlet 102 and the water outlet 104. In some forms, the condenser comprises a coil of pipes in order to increase the surface area between the pool water and the enclosed system 130. The heat flows from the condensed refrigerant to the pool water, heating the pool water as it flows from the inlet 102 to the outlet 104.

The temperature of the condensed refrigerant, and the total amount of thermal energy in the condenser, depend on the amount by which the compressor compresses the refrigerant. Specifically, a more compressed refrigerant will contain more heat per unit of volume, such as the volume of the condenser, than a less compressed refrigerant.

The pressure switch 132 is operatively coupled to the system 130 to measure the pressure of the refrigerant. When the pressure switch 132 is closed, the indicator 116 is powered. When the pressure switch 132 opens, power to the indicator 116 is cut. In one embodiment, when the pressure is above a predetermined value, the switch 132 is open and the indicator 116 is not powered. When the pressure drops below the predetermined value, the switch 132 closes and the indicator 116 is powered. A powered indicator 116 indicates to a user that the heat pump 100 is not operating at preferred efficiency. In alternative embodiments, the open and closed conditions are swapped such that the indicator represents good efficiency when powered. Thus, in some forms the system may be configured to monitor and take action based on a single threshold being reached while in others the system may be configured to monitor upper and lower thresholds that define a window of operation deemed efficient to ensure optimal efficient performance is being maintained.

Figure 3:
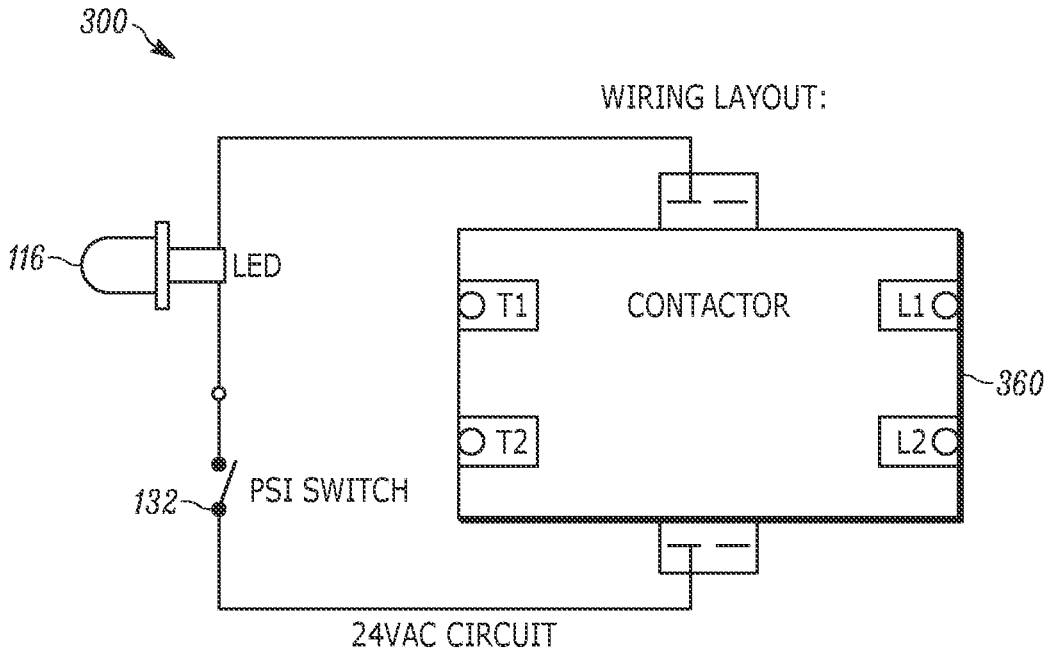
FIG. 3 is a partial schematic of the heat pump of FIG. 1A.

The schematic 300 (see, FIG. 3) illustrates some of the electrical components of the pump 100. Specifically, the schematic 300 illustrates an operation efficiency apparatus circuit comprising the pressure sensor which includes indicator 116 and pressure switch 360 which includes a switch 132 for activating or deactivating indicator 116 based on the pressure detected by pressure switch 360. As discussed above, in some forms the pressure sensor comprises a pressure sensor, a controller, and a switch. In some forms, the pool heater pump or motor of the pump would be connected to the T1, T2 terminals and power to the L1, L2 terminals. When the pressure sensor detects operation out of the desired range of efficiency, switch 132 will be closed and indicator 116 will be illuminated to indicate the system is not running efficiently and needs to be serviced.

In alternative embodiments having two lights to indicate performance, the pressure switch 132 instead of being movable from an open state to a closed state is movable from a first connection to a second connection. The indicator 116 comprises at least two lights, preferably of different colors. When the pressure is above the desired pressure threshold, the switch 132 connects power or closes the circuit to a first light indicating good efficiency. When the pressure falls below the desired threshold, the switch 132 switches the power connection to the second light, indicating poor efficiency. As also mentioned above, the system could be configured to operate looking at a single threshold, while in other forms the system may be configured to look at a window of desired operation and indicate when the system is and/or is not operating within that desired window. In a preferred form, a green indicator, such as a green LED, would be used when the system is operating with desired efficiency and a red, orange or yellow indicator, such as a red, orange or yellow LED, would be used to indicate the system is not operating with the desired efficiency.

In still further embodiments, the switch 132 is operable to move from an open state to a closed state based on whether or not the pressure is within a specific range of values. If the pressure is within the range, the switch 132 is in a first state. If the pressure either fall below that range or rises above that range, the switch 132 moves to a second state. For example, when within the range, the switch 132 is open. When the pressure is above or below that range, the switch 132 moves to a closed state, supplying power to the indicator 116. In operation, this embodiment can detect inefficiencies due to errors in the high pressure or low pressure side of the system 130. If the low pressure side is not allowing the refrigerant to expand enough to fall to a desired pressure, the compressor will compress the refrigerant to a higher than expected pressure. Thus a fault in the low pressure side of the system can be detected. In other forms it may be desired to operate in the opposite manner (e.g., illuminating an indicator when the system is operating with a desired pressure or pressure range and not illuminating the indicator if the system is not operating with the desired pressure or pressure range).

In still further embodiments, the switch 132 comprises a plurality of switches and/or a single switch controlled by a plurality of pressure sensors. At least one sensor or switch is configured to measure the pressure of the compressed refrigerant in the high pressure side. At least one second sensor or switch is configured to detect pressure of the expanded refrigerant in the low pressure half of the system 130. If either sensor or switch detects a pressure that is outside of a desired range, or above or below a predetermined threshold, the indicator light 116 is operated. For example, if the high pressure side pressure is too low or the low pressure side pressure is too high, the indicator 116 is powered to indicate poor efficiency.

In addition to the above-mentioned embodiments, it should be understood that a variety of methods are also disclosed herein. For example, methods of manufacturing a waste container or receptacle are disclosed herein, as are methods for transporting waste containers/receptacles and methods of loading or unloading receptacles. As are methods of manufacturing the devices described herein, and cleaning a kitchen or grocery store. These and other methods related to the subject matter set forth herein are intended to be covered by this disclosure. It should also be understood that while certain features have been described with certain embodiments, these features may be intermixed or interchanged with one another to form other embodiments as desired. All features disclosed herein are intended to be used in any of the embodiments disclosed herein either in lieu of similar features or in combination with other features. For example the handles 512 of the receptacles 500 may be configured like the handles 112 of the receptacle 100 for hooking over the rim of a dumpster. Similarly, the receptacle 100 may have a one piece configuration like the receptacle 500 instead of separable upper and lower members.

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. An operational efficiency apparatus comprising:

a sensor connected to a heat transfer system to detect efficiency of the heat transfer system; and a display electrically connected to the sensor and including a first and second light to indicate a current operating efficiency of the heat transfer system, the first light illuminating while the heat transfer system continues to operate when the data from the sensor indicates the heat transfer system is currently operating at a desired efficiency, the second light illuminating while the heat transfer system continues to operate when the data from the sensor indicates the heat transfer system is not currently operating at the desired efficiency.

2. The operational efficiency apparatus of claim 1 wherein the heat transfer system has a refrigerant system and the sensor is a pressure sensor for detecting pressure of the refrigerant system of the heat transfer system and the first light illuminates if the data from the pressure sensor indicates the refrigerant system is operating at a desired pressure and the second light illuminates if the pressure sensor indicates the refrigerant system is operating at an undesired pressure.

3. The operational efficiency apparatus of claim 2 wherein the second light only illuminates if the detected pressure is above a desired pressure range.

4. The operational efficiency apparatus of claim 2 wherein the second light is an LED which is illuminated to signify that the heat transfer system needs to be serviced.

5. The operation efficiency apparatus of claim 1 further comprising a housing, wherein the display comprises a light mounted on an exterior wall of the housing.

6. A pool heat pump apparatus comprising:

a housing defining an inner opening;

a compressor disposed within the inner opening and connected to a refrigerant system having a high pressure side and a low pressure side;

a heat exchanger disposed within the inner opening within which at least a portion of the refrigerant system is disposed for heating fluid entering at a fluid inlet and discharging the heated fluid at a fluid outlet;

at least one fan for circulating air through the apparatus; and an operational efficiency apparatus connected to the pool heat pump apparatus and having a first sensor monitoring a pressure associated with the high pressure side of the refrigerant system on a first side of an expansion valve of the refrigerant system and a second sensor monitoring a pressure associated with the lower pressure side of the refrigerant system on a second side of the expansion valve, and the operational efficiency apparatus displaying on a display data relating to the efficiency of the operation of the pool heat pump apparatus, wherein the display is at least one light which the operational efficiency apparatus illuminates while the pool heat pump apparatus continues to operate to indicate that the operational efficiency apparatus has determined the refrigerant system is operating at an undesired pressure.

7. The pool heat pump apparatus of claim 6 wherein the first sensor is a first pressure sensor for monitoring operational efficiency of the pool heat pump apparatus.

8. The pool heat pump apparatus of claim 6 wherein the operational efficiency apparatus illuminates the at least one light to indicate that the operational efficiency apparatus has determined the refrigerant system is operating at a desired pressure.

9. The pool heat pump apparatus of claim 8 wherein the light of the display only illuminates if the detected pressure is outside of a desired pressure range.

10. The pool heat pump of claim 8 wherein the at least one light comprises two lights, a first of the two lights illuminates if the detected pressure is below a threshold value, the second of the two lights illuminates if the detected pressure is above the threshold value.

11. The pool heat pump apparatus of claim 8 wherein the at least one light is an LED which is illuminated to signify that the heat transfer system needs to be serviced.

12. The pool heat pump apparatus of claim 6 wherein the display includes a light that the operational efficiency apparatus illuminates if either the first or second sensor detect pressure outside of a desired range.

13. A pool heat pump apparatus comprising:

a pool heat pump housing defining an inner opening;

a compressor disposed within the inner opening and connected to a refrigerant system;

a heat exchanger disposed within the inner opening within which at least a portion of the refrigerant system is disposed for heating fluid entering at a fluid inlet and discharging the heated fluid at a fluid outlet;

at least one fan for circulating air through the apparatus; and an operational efficiency indicator connected to the pool heat pump housing and providing a real-time indication of the operational efficiency of the pool heat pump, the operation efficiency indicator including:

at least one sensor for monitoring pressure associated with the apparatus; and at least one light that illuminates on a real-time basis as the pool heat pump continues to operate to indicate when the operational efficiency of the pool heat pump apparatus is efficient operation such that service is not needed; and inefficient operation such that service is needed.

14. The apparatus of claim 13 wherein the at least one sensor comprises a first pressure sensor monitoring a pressure associated with a high pressure side of the refrigerant system and a second pressure sensor monitoring a pressure associated with a lower pressure side of the refrigerant system.

15. The apparatus of claim 13 wherein the at least one light is at least one LED capable of indicating on a real-time basis when the apparatus is operating efficiently by displaying a first color and/or indicating on a real-time basis when the apparatus is operating inefficiently by displaying a second color different than the first.

* * * * *